US008342908B2

(12) United States Patent
Vontell

(10) Patent No.: US 8,342,908 B2
(45) Date of Patent: Jan. 1, 2013

(54) THERMAL MECHANICAL SKIVE FOR COMPOSITE MACHINING

(75) Inventor: John H. Vontell, Manchester, CT (US)

(73) Assignee: United Technologies Corporation, Hartford, CT (US)

( * ) Notice: Subject to any disclaimer, the term of this patent is extended or adjusted under 35 U.S.C. 154(b) by 590 days.

(21) Appl. No.: 12/550,670

(22) Filed: Aug. 31, 2009

(65) Prior Publication Data

US 2011/0053468 A1 Mar. 3, 2011

(51) Int. Cl.
*B24B 49/00* (2012.01)

(52) U.S. Cl. ..... 451/7; 451/53; 451/166

(58) Field of Classification Search ..... 451/7, 53, 451/165, 166

See application file for complete search history.

(56) References Cited

U.S. PATENT DOCUMENTS

| | | | | | |
|---|---|---|---|---|---|
| 2,684,531 | A | * | 7/1954 | Smith | 30/140 |
| 3,787,969 | A | * | 1/1974 | Hammar | 30/140 |
| 3,810,808 | A | * | 5/1974 | Anderson | 156/389 |
| 4,328,410 | A | * | 5/1982 | Slivinsky et al. | 219/121.69 |
| 4,796,880 | A | * | 1/1989 | Tamary | 271/311 |
| 4,829,859 | A | | 5/1989 | Yankoff | |
| 4,836,858 | A | * | 6/1989 | Reinhart | 134/1 |
| 4,858,264 | A | * | 8/1989 | Reinhart | 15/93.1 |
| 5,091,034 | A | * | 2/1992 | Hubert | 156/711 |
| 5,269,874 | A | * | 12/1993 | Winter | 156/750 |
| 5,620,754 | A | | 4/1997 | Turchan et al. | |
| 5,782,253 | A | * | 7/1998 | Cates et al. | 134/105 |
| 6,085,415 | A | | 7/2000 | Gandhi et al. | |
| 6,462,305 | B1 | | 10/2002 | Crevasse et al. | |
| 6,732,620 | B1 | | 5/2004 | Brodmann et al. | |
| 2006/0280930 | A1 | | 12/2006 | Shimomura et al. | |
| 2007/0187381 | A1 | | 8/2007 | Vontell, Sr. et al. | |
| 2008/0041842 | A1 | | 2/2008 | Alexander et al. | |

* cited by examiner

*Primary Examiner* — Maurina Rachuba
(74) *Attorney, Agent, or Firm* — Kinney & Lange, P.A.

(57) ABSTRACT

An apparatus for thermal mechanical machining of composite materials includes a head, a drive, and a shaft. The head has an abrasive face. The drive is coupled to the apparatus to move the head to produce abrasion of the composite material by the abrasive face. The shaft includes a passageway that communicates a heated gas to an interface between the abrasive face and the composite material. The gas removes particles that result from the abrasion of the composite material by the abrasive face. The gas can be heated sufficiently to carbonize or vaporize organic constituents of the composite material.

19 Claims, 4 Drawing Sheets

FIG. 3
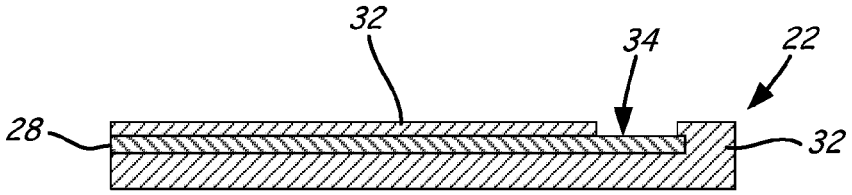
FIG. 4
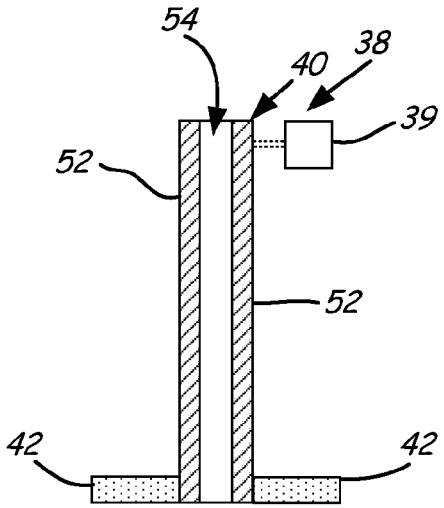
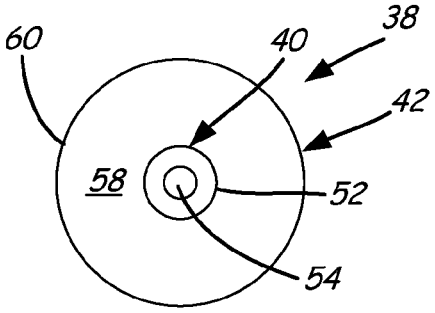
FIG. 5

THERMAL MECHANICAL SKIVE FOR COMPOSITE MACHINING

STATEMENT OF GOVERNMENT INTEREST

This invention was in part produced through funding under a U.S. Government sponsored program (Contract No. N00019-02-C-3003) and the United States Government has certain rights therein.

BACKGROUND

The present invention relates generally to a machining apparatus and more particularly to a thermal mechanical apparatus for machining composite materials.

"Skiving" is a term used to describe a machining process in which small portions of material are removed from a part. A skive is the apparatus used to remove portions of the part. Laser skives or mechanical skives are currently used on products in industries including semiconductor, aerospace, and photographic and optical equipment.

Laser skives have been used to remove composite layer(s) when the composite utilizes an organic fiber (i.e., a fiber containing carbon, hydrogen, nitrogen, and/or oxygen compounds) such as graphite or an organic polymer matrix such as epoxy. Laser skiving relies on the thermal decomposition of the organic constituents of the composite in the presence of oxygen (oxidation) or the exclusion of oxygen (pyrolysis). However, laser skiving becomes ineffective for material removal when the composite being machined utilizes an inorganic fiber or filler such as fiberglass, metal or silica, or has organic constituents which thermally convert to inorganic constituents (e.g., silicone). Additionally, laser skives are not easily controllable to remove composite layers having non-uniform thickness or surface irregularities.

Mechanical skiving also has drawbacks which include the fact that it may be difficult to dimensionally control the machined cavity produced. For example, when the surface of the composite layer being exposed by machining is thin and/or is located in a position difficult to reference by traditional machining techniques, the ability to machine to the surface of the layer can result in damage to the layer or failure to adequately expose the layer. Inaccurate machining can impair desired properties of the composite such as the ability of the constituents of the composite to transfer and/or convert electrical energy into heat energy.

SUMMARY

An apparatus for thermal mechanical machining of composite materials includes a head, a drive, and a shaft. The head has an abrasive face. The drive is coupled to the apparatus to move the head to produce abrasion of the composite material by the abrasive face. The shaft includes a passageway that communicates a heated gas to an interface between the abrasive face and the composite material.

In another aspect, a method of machining a composite material includes positioning a thermal mechanical skive with a gas conduit and a head having an abrasive face adjacent a composite material, moving the abrasive face against the composite material, and heating a gas to a temperature sufficient to either vaporize or carbonize organic constituent(s) of the composite material, and delivering the gas through a passageway in the thermal mechanical skive to an interface between the abrasive face and the composite material.

BRIEF DESCRIPTION OF THE DRAWINGS

FIG. 3 is a sectional view of the heater mat with an electrical plug removed taken along line 3-3 of FIG. 2.

FIG. 4 is a sectional view of one embodiment of a thermal mechanical skive.

FIG. 5 is a view of one embodiment of an abrasive face of the thermal mechanical skive.

DETAILED DESCRIPTION

Figure 1:
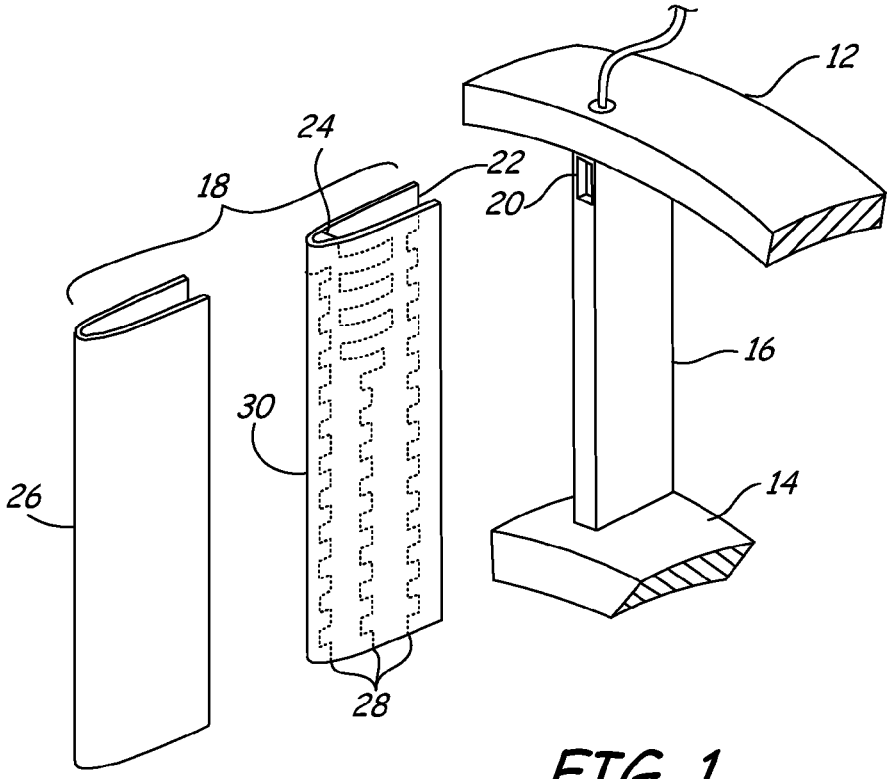
FIG. 1 is a perspective view of a section of an inlet case and an inlet strut of a gas turbine engine with an inlet shroud fairing exploded away to show portions of a heater system including a heater mat.

FIG. 1 is a perspective view of a portion of an outer case 12 and an inner case 14 interconnected by one inlet strut 16. FIG. 1 also includes an exploded perspective view of one shroud fairing 18. The outer case 12 has an exit port 20 adjacent to inlet strut 16 for electrical conduit 24. The shroud fairing 18 includes a heater mat 22 and a shell 26. The heater mat 22 includes heating elements 28 and has a leading edge 30.

FIG. 1 merely illustrates one exemplary embodiment of an aerospace component that has a composite structure which can utilize both/either organic (i.e., a material containing carbon, hydrogen, nitrogen, and/or oxygen compounds) and/or inorganic constituents. Many other fabricated composite components, including aerospace components other than the gas turbine engine components, utilize composite components with organic and/or inorganic constituents and therefore would benefit from the present invention. Moreover, the present invention described herein would be beneficial to any composite component (with organic and/or inorganic constituents) in which it is desirable to remove material therefrom.

The inlet strut 16 extends radially inward from the annular outer case 14 to the annular inner case 16. The exit port 20 extends through the outer case 12 is complementary to and receives the electrical conduit 24 when the shroud fairing 18 is assembled on the inlet strut 16.

The shroud fairing 18 includes the U-shaped folded heater mat 22, which surrounds and wraps the leading edge portion of the inlet strut 16. When assembled, the electrical conduit 24 interconnects with electrical pads or contacts imbedded in the heater mat 34 through the shell 26 and is electrically connected to supply an electrical charge to heating elements 28. The shell 26 interfaces with and is integral with the heater mat 22. In one embodiment, the shell 26 is a polymer matrix composite.

A manufacturing process bonds and integrates the shell 26 and the heater mat 34. In one embodiment, this process is accomplished by resin transfer molding. Alternatively, the shell 26 can be joined to the heater mat 22 as an insert by another type of molding such as compression molding. The electrical conduit 24 can be joined to the heater mat 22 by, for example, welding, soldering, mechanical contact or electrically conducting adhesives.

The heater mat 22 may be constructed from any electrically isolating suitable composite material or composite polymer matrix. The metallic heating elements 28 are disposed on a surface of mat 22 extend along the radial length of the heating mat 22 and may be sputtered, or flame sprayed when the mat is a woven product; insert molded, or adhesively bonded to the heating mat 22 when the mat is a solid product. The heater mat 22 may have additional electrically isolating layers. In FIG. 1, the heating elements 28 illustrated are imbedded within the heating mat 22 and are therefore illustrated with dashed lines.

When the shroud fairing 18 is assembled to inlet strut 16, a leading portion of the shell 26 abuts the inlet strut 16. The sides of the heater mat 22 and shell 26 extend rearward around a portion of each inlet strut 16 and may be secured thereto by fasteners or adhesive. The exit port 20 in the outer case 12 receives the electrical conduit 24 to supply power to the heating elements 28. The heating elements 28 are electrically resistive to convert electrical energy into heat energy and provide the heat along the entire length of the outer shell 26 thereby anti-icing (preventing the formation of ice on the exterior surface of the outer shell 26 and in any space between the heater mat 22 and the inlet strut 16) or de-icing (allowing the formation of ice followed by controlled release of the ice on the exterior surface of the shell 26 and in any space between the heater mat 22 and the inlet strut 16).

Figure 2:
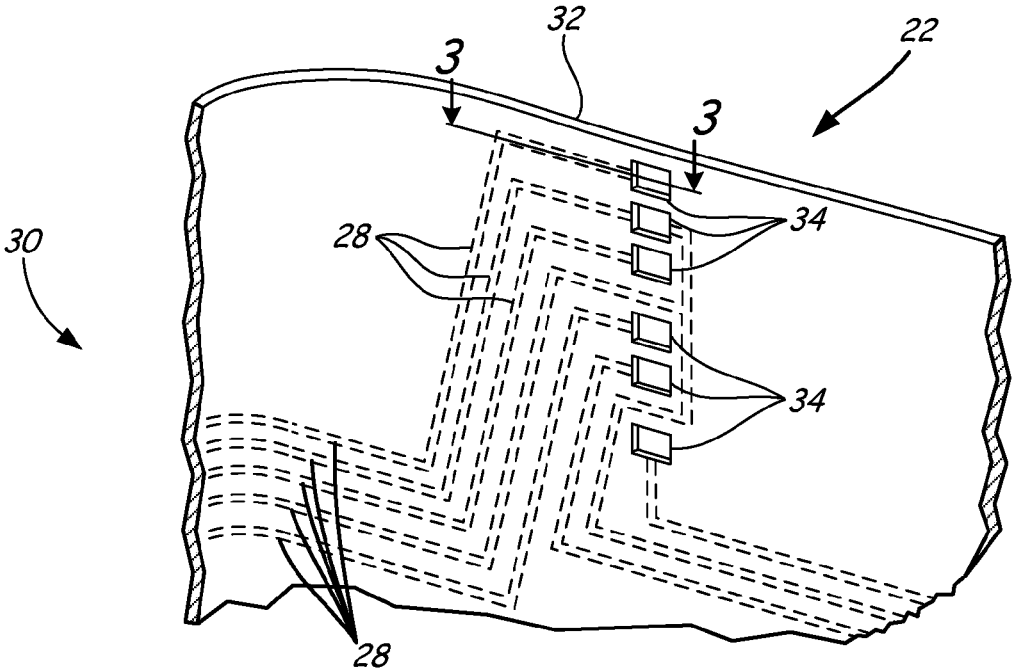
FIG. 2 is a rear perspective view of electrical contacts in the heater mat of FIG. 1.

FIG. 2 shows a perspective view of the top exterior portion of the heater mat 22. In addition to the heating elements 28, the heater mat 22 includes a fabric layers 32 and electrical contacts 34.

In FIG. 2, the heating elements 28 are an electrically resistive metallic which is disposed on a single fabric layer 32 within the heating mat 22 and are therefore shown with dashed lines. The heating elements 28 are covered by an additional fabric layer(s) 32 and extend from the lower radial portions of the heater mat 22 to the generally rectangular shaped electrical contacts 34. Alternatively, only the single fabric layer 32 with the heating elements 28 disposed thereon can comprise the heater mat 22. In such an instance the heating elements 28 would be illustrated with solid lines. The electrical contacts 34 connect with the heating elements 28 and are disposed on a single fabric layer 32. The electrical contacts 34 are electrically contacted by traditional terminations on the electrical conduit 24 (FIG. 1) when the shell 26 is assembled with the heater mat 22.

Like the heating elements 28, the electrical contacts 34 are comprised of a electrically conductive metallic material such as titanium, stainless steel, nickel alloys, copper alloys or copper. If the electrical contacts 34 are embedded within the shell 26 or are covered by additional fabric layer(s) 32 of the heater mat 22, the electrical contacts 34 must be exposed by, for example, removing the fabric layer(s) 32 or layer(s) of the shell 26 thereabove to allow for an effective electrical connection to be made between the electrical contacts 34 and the electrical conduit 24 (FIG. 1).

The fabric layer 32 on which the heating elements 28 are disposed acts as a backing material to support the heating elements 28 extending along it. In one embodiment, the fabric layer 32 contains a densely woven organic electrically insulating (i.e., a material containing carbon, hydrogen, nitrogen, and/or oxygen compounds) and/or inorganic material such as fiberglass or a polymer film. Examples of suitable densely woven materials that may be used include a fiberglass fabric, such as Style 106, which is made commercially available by Clark Schwebel Tech-Fab Company of Anderson, S.C., and a polymer film, such as Kapton, which is made commercially available by DuPont High Performance Materials of Circleville, Ohio. In other embodiments, the fabric layer 32 contains a densely woven organic and/or inorganic material that is itself electrically insulating and is geometrically configured to electrically insulate an electrically conductive component, such as one formed of a carbon composite or a metal alloy, from the metallic heating elements 28, while at the same time, thermally conduct heat generated by heating elements 28. In situations where the fabric layer 32 also electrically insulates the heating elements 28, it is desirable for the fabric material forming the fabric layer 32 to be woven tightly enough to be electrically insulating. Electrically insulating materials that may be used to form the fabric layer 32 include fiberglass, Nextel or another suitable ceramic fiber fabric. The densely woven material of the fabric layer 32 can also be impregnated with a high-temperature resin (not shown). Examples of suitable high-temperature resins include, but are not limited to, bismaleimide, phthalonitrile, cyanate ester, polyimide adhesive, and polyimide resin. Specific examples of various embodiments of resins, the heating element 28 and the fabric layer 32, including their constituents, arrangements, volumetric ratios, and properties are disclosed in United States Patent Application Publication Number 2007/0187381 A1, which is incorporated herein by reference. In yet other embodiments, the composite can contain an organic and/or inorganic filler or fiber orientated in a random or organized pattern.

FIG. 3 is a sectional view of the assembled shroud fairing 18 which includes the integrated shell 26 and heater mat 22 after a skive machining apparatus (described below) has removed composite material 35 covering the electrical contact 34. As indicated previously, the shroud fairing 18 includes the shell 26 and the heater mat 22 which further includes the heating elements 28, the fabric layers 32 and the electrical contacts 34. Both the shell 26 and heater mat 22 are comprised of composite materials 35. Due to the integrated assembly of the shell 26 with the heater mat 22, no distinction is made between the two features in the remainder of the FIGURES in this specification.

As previously indicated, in one embodiment of the heater mat 22 the heating elements 28 and electrical contacts 34 are disposed on a single fabric layer 32. In other cases, if only a single fabric layer 32 was utilized in heater mat 22 the heating elements 28 and electrical contacts 34 were used in the shroud fairing 18, subsequent steps in the manufacturing process (including the embedding within shell 26 or bonding of the heater mat 22 to other components of the turbine engine) may cover portions of the heating elements 28 and electrical contacts 34 with material(s) such as the high-temperature resin discussed previously. These materials imbed the heating elements 28 and electrical contacts 34 and do not allow for a good electrical connection to occur upon assembly. In either case, the inventive apparatus and method described herein can be used to remove the material covering the electrical contacts 34 to allow for an effective electrical connection to be made.

FIG. 4 is a sectional view of one embodiment of a skive apparatus 38. In the embodiment illustrated in FIG. 4, the skive 38 includes a drive 39, a conduit 40, and a head 42. The conduit 40 includes a shaft 52 with a flow passageway 54 therein.

The conduit extends through and is bonded to the generally circular head 42. The conduit 40 directs the flow of the gas G or gas mixture to the exterior surface of the head 42 which interfaces a composite surface during the machining operation of the skive 38. In this embodiment, the gas G is heated to the desired temperature prior to entering the conduit 40. The conduit 40 includes the rigid inelastic shaft 52 which has the gas flow passageway 54 extending through therethrough from a side port (not shown). This configuration allows the shaft 52 to be clamped or otherwise affixed to the drive 39 such as a mechanical drill press or piezoelectric actuator. The shaft 52 transfers drive movement generated by the drive 39 to the head 42.

More specifically, the conduit 40 extends through the axis of symmetry of the head 42. The head 42 has an abrasive face adapted to interface with a composite material work piece. In one embodiment, the abrasive face is comprised of a hard material, for example: silica, silicon carbide or diamond. The type of material selected for the abrasive face of the head 42 is determined by a combination of criteria including the strength of the composite being machined, the desired tool life, and the desired composite surface tolerance or finish. The head 42 can be a backer for the abrasive face or can be constructed from the same material as the abrasive face. Alternatively, the conduit 40 can extend around the edge of the head 42 rather than through it along the axis of symmetry. In addition to bonding, the conduit 40 can be joined to the head 42 by, for example, welding, brazing, soldering, mechanical crimping/stapling or adhesives. The shaft 52 portion of the conduit 40 can be comprised of a metallic such as steel, or another suitable composite, polymeric, or ceramic material. The rigid shaft 52 configuration allows the conduit 40 to be clamped or otherwise affixed to the drive 39. The shaft 52 transfers drive movements generated by the drive 39 to the head 42. Alternatively, a flexible conduit may be utilized rather than a rigid shaft if the drive 39 is clamped or otherwise affixed directly to the head 42 rather than the shaft.

The conduit 40 directs the flow of a gas G to the abrasive surface of the head 42. Thus, the gas G flow is delivered to the interface between the abrasive surface of the head 42 and the composite material being machined. The quantity of gas G flow should be sufficient to remove machined particles that result from the drive movement of the head 42 against the composite. The gas G may include any gas or mixture of gases. In one embodiment, the gas G contains a suitable quantity of oxygen to support oxidation adjacent the exterior surface of the head 42. In another embodiment, the gas G or mixture of gases, contains a sufficient quantity of an inert gas to support pyrolysis adjacent the exterior surface of the head 42.

The gas G can be heated to a desired temperature prior to entering the conduit 40. The desired temperature will vary depending upon the composition of the composite being machined by the skive apparatus 38. For applications in which the composite being machined contains both organic and inorganic constituents it may be desirable to convert the organic constituents to behave like a brittle inorganic. The brittle converted constituents can then be broken up and removed by the mechanical action of the skive apparatus 38. For example, a gas G temperature upwards of about 316° C. (about 600° F.) in the presence of oxygen can be used if it is desirable to carbonize the organic constituent(s) of the composite being thermally and mechanically machined by the skive apparatus 38. In other applications, it may be desirable to thermally convert the organic constituents of the composite to gas(es) rather than mechanically removing them. For example, a gas G temperature of around 650° C. (around 1200° F.) can be used in the presence of oxygen to vaporize (chemically convert to carbon dioxide, carbon monoxide, nitrogen dioxide, nitrogen monoxide and water) any organic constituent(s) of the composite. A gas G temperature of around 540° C. (around 1000° F.) can be used in the absence of oxygen (for example by using an inert gas such as argon to blanket the composite surface being machined) to pyrolize any organic constituent(s) of the composite. The dual thermal and mechanical features of the skive apparatus 38 allow it to effectively remove both the organic and inorganic constituents of composites whether through thermal degradation, mechanical action or both.

FIG. 5 is a view of one embodiment of the bottom of the head 42 of the skive apparatus 38. The skive apparatus 38 includes the head 42 and conduit 40. The head 42 includes the abrasive face 58 alluded to earlier and an edge 60. The conduit 40 includes the shaft 52 and the flow passageway 54.

The conduit 40 extends through the head 42. This allows gas flow from the flow passageway 54 to communicate with the abrasive face 58 of the head 42. This abrasive face 58 interfaces with the composite material being machined by the skive apparatus 38. The upward and downward drive movement of the head 42 discussed subsequently allows the gas G flow from the flow passageway 54 to transport the machined particles that result from the drive movement of the head 42 against the composite material generally outward to the edge 60 of the head 42.

Figure 6:
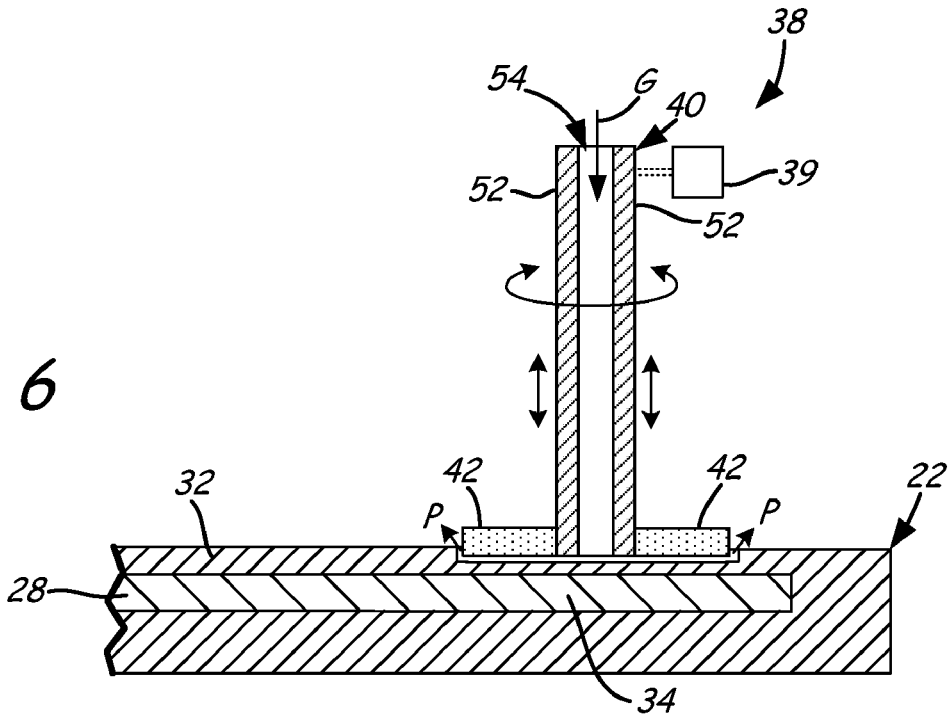
FIG. 6 is a sectional view illustrating the thermal mechanical skive of FIG. 4 machining the heater mat.

FIG. 6 is a sectional view illustrating one embodiment of the skive apparatus 38 machining the shroud fairing 18. The skive apparatus 38 includes the drive 39, the conduit 40, and the head 42. The conduit 40 includes the shaft 52 and the flow passageway 54. The shroud fairing 18 includes heating elements 28, the electrical contact 34, and composite materials 35.

The drive movement is generated by drive 39 which is secured to the shaft 52 or another portion of the skive 38 such as the head 42. The drive 39 may vary depending upon the application and the composite being machined and can include, for example, a mechanical apparatus for generating motion such as a drill press, a piezoelectric excited apparatus, a pneumatic or hydraulic actuated apparatus or a manually actuated apparatus such as an operator's hand. In FIG. 6, the drive 39 generates drive movements in a repetitious back-and-forth motion as illustrated. Other modes of drive movement can be generated by the drive 39 and include a downward motion that selectively contacts the head 42 with the shroud fairing 18 and an upward motion that selectively disengages the head 42 from contact with the shroud fairing 18. Another mode of drive movement can include a rotational motion in which the skive 38 is spun continuously around a rotational axis.

The drive movement of the head 42 against the shroud fairing 18 (along with some downward force pressing the head 42 against the shroud fairing 18) breaks up the shell 26 and the additional fabric layer(s) 32 of the heater mat 22 into particles P after thermal removal or conversion of the organic constituents. In FIG. 6, in addition to the back-and-forth oscillatory motion, the skive 38 also moves downward to selectively contact the head 42 with the heater mat 22 and upward to selectively disengage the head 42 from contact with the shroud fairing 18. During engagement of the head 42 with the fabric layer 32, the back-and-forth motion breaks the fabric layer 32 into the particles P. During the upward movement when the head 42 is not in contact with the shroud fairing 18, the gas G flow from the flow passageway 54 transports the machined particles P generally outward to the edge 60 of the head 42 and away from the machined area. The particles P and gas are blown out together from the edge 60 of the head 42 away from the area of the shroud fairing 18 being machined. The thickness of the shroud fairing 18 above the electrical contacts 34 gradually decreases in thickness as the shroud fairing 18 comes into contact with the head 42 as a result of the mechanical action of the head 42 (and the thermal degrading of the fabric layer 32 by the gas G if organic constituents are used).

Figure 7:
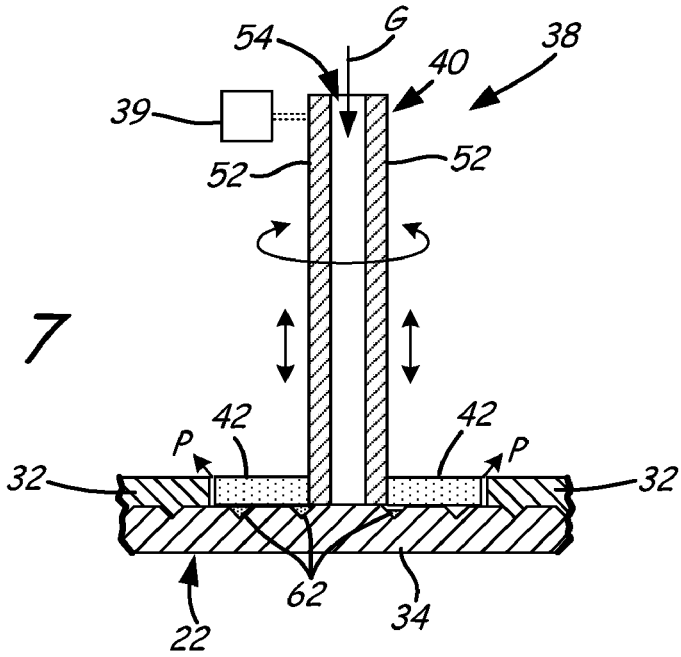
FIG. 7 is a sectional view of the thermal mechanical skive machining the heater mat to contact a heating element therein.

FIG. 7 is a sectional view of the skive apparatus 38 from FIG. 6 machining the shroud fairing 18 to contact with the electrical contacts 34 which are disposed on a single fabric layer 32 that is not individually visible to the viewer. Irregularities or pockets in the electrical contact 34 have been enlarged for the viewers benefit and several irregularities are shown with organic material 62 in them. In the case of the heater mat 22, the organic material 62 may be the resin that is used in the resin transfer molding process which bonds the heater mat 22 to the shell 26. The pockets of organic material 62 (resin in one embodiment) would interfere with the electrical connection between the electrical contact 34 and the electrical conduit 24 (FIG. 1), if they were not removed by the skive 38.

As the head 42 reaches the electrical contact 34, gas G flow heats the organic material 62 in the pockets and converts the organic material 62 so that it behaves like a brittle inorganic. This brittle converted material can then be broken up by the drive movement of the head 42 and removed by the gas G flow. One example of this conversion is combustion which was discussed earlier. Another example of conversion is pyrolization, which converts the organic material 62 in the pockets to gas(es). When vaporization occurs the organic material 62 does not have to be mechanically removed by the head 42.

As a result of removal of the organic material 62 and/or inorganic material by the skive apparatus 38 a more uniformly fabricated composite layering results. This more uniform layering allows a more effective electrical connection to be created between the electrical contact 34 and the electrical conduit 24 (FIG. 1).

Figure 8:
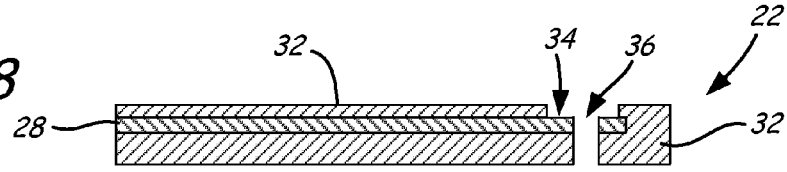
FIG. 8 is a sectional view of another embodiment of the heater mat.

FIG. 8 is a sectional view of the shroud fairing 18 after a skive machining apparatus has removed a portion of the shroud fairing 18 covering the electrical contact 34. In FIG. 8, the shroud fairing 18 includes composite materials 35 and a guide hole 36.

In FIG. 8, the guide hole 36 is drilled through the heater mat 22 and each electrical contact 34 prior to when the inventive apparatus and method described herein are used to remove the material from above the electrical contacts 34. The guide hole 36 may be a thru hole or may have a depth sufficient to receive a projecting portion of one embodiment of the skive.

Figure 9:
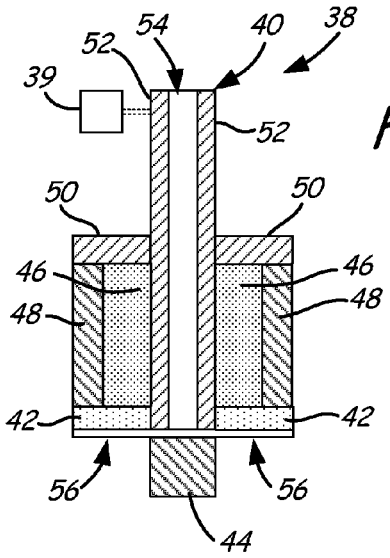
FIG. 9 is a sectional view of another embodiment of the thermal mechanical skive.

FIG. 9 is a sectional view of another embodiment of a skive apparatus 38. In the embodiment illustrated in FIG. 9, the skive 38 includes the drive 39, the conduit 40, the head 42, and additionally includes a guide pin 44, a heater element 46, insulation 48, and a pad 50. The conduit 40 includes the shaft 52 with the flow passageway 54 extending therethrough. The head 42 and shaft 52 include channels 56.

The conduit 40 extends through and is bonded to the generally circular head 42. The cylindrical guide pin 44 extends beyond the head 42 and conduit 40. The heater element 46 (in one embodiment an electrical unit) extends around the conduit 40 and abuts an upper portion of the head 42. The insulation 48 surrounds an exterior surface of the heater element 46 and abuts an upper portion of the head 42. The heater element 46 and the insulation 48 extend axially along the length of the conduit 40 to interconnect with an upper low friction pad 50. The gas flow passageway 54 extends through the length of the shaft 52 to transport gas therethrough. In one embodiment, the flow passageway 54 communicates with the channels 56 which extend into the abrasive surface of the head 42 and the bottom of the shaft 52. The channels 56 extend generally radially outward to the edge of the head 42.

As illustrated in FIG. 9 the guide pin 44 can be affixed to the conduit 40 or head 42, or can be machined directly from the conduit 40. The embodiment of the skive apparatus 38 shown in FIG. 9 operates similarly to the embodiment shown in FIG. 4. For example, the conduit 40 directs the flow of the gas G or gas mixture to the abrasive surface of the head 42, which interfaces the composite material work piece being machined by the skive 38. The gas G is heated to a desired temperature by the heater element 46 in the conduit 40. Like the other embodiment of the skive 38 shown in FIG. 4, the desired temperature can be sufficient to combust or pyrolize the organic constituents of a composite material that is being machined by the skive apparatus 38.

Figure 10:
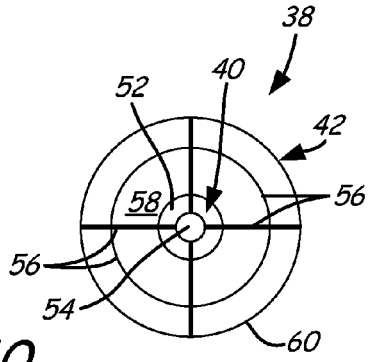
FIG. 10 is a view of another embodiment of the abrasive face of the thermal mechanical skive.

FIG. 10 is a view of another embodiment of the bottom of the head 42 of the skive apparatus 38. The skive apparatus 38 illustrated in FIG. 10 includes the head 42 with channels 56 therein. The head 42 also includes the abrasive face 58 and the edge 60. The conduit 40 includes the shaft 52 with the gas flow passageway 54 therein. The shaft 52 also includes channels 56 therein.

The conduit 40 extends through the head 42. The channels 56 extend into the abrasive face 58 of the head 42 and the shaft 52. This configuration allows the channels 56 to be in fluid communication with the flow passageway 54. In this arrangement, the channels 56 can transport the gas flow from the flow passageway 54 outward along the abrasive face 58 of to the edge 60 of the head 42. The abrasive face 58 interfaces the composite material being machined by the skive apparatus 38. The gas G flow in the channels 56 transports machined particles that result from the drive movement of the abrasive face 58 against the composite material generally outward to the edge 60 of the head 42. The channels 56 may have different geometric configurations and may interconnect with each other in patterns other than the circumferential ringed pattern illustrated.

Figure 11:
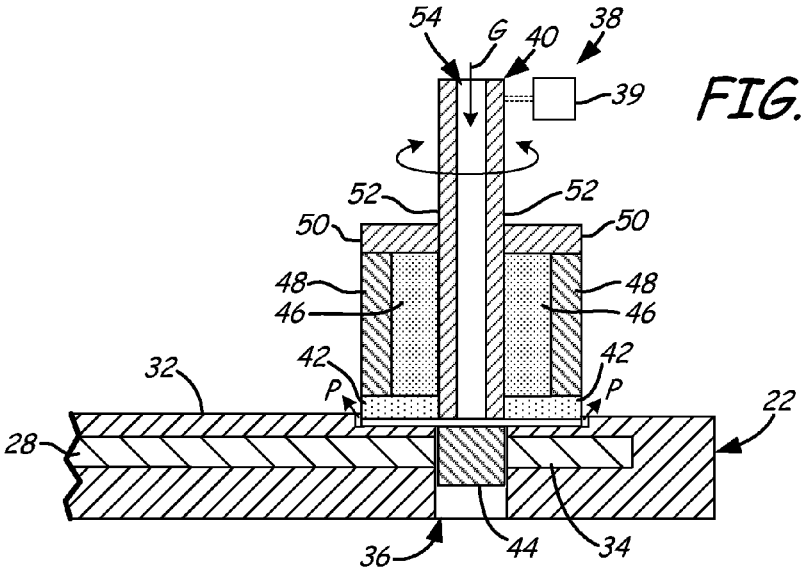
FIG. 11 is sectional view illustrating the thermal mechanical skive of FIG. 9 machining one embodiment of the heater mat.

FIG. 11 is a sectional view illustrating another embodiment of the skive apparatus 38 machining the shroud fairing 18. The skive 38 illustrated in FIG. 11 includes the conduit 40, the head 42, the guide pin 44, the heater element 46, insulation 48, and the pad 50. The conduit 40 includes the shaft 52 and the flow passageway 54. The head 42 includes channels 56. The shroud fairing 18 includes heating elements 28, the fabric layer 32, electrical contact 34 and the guide hole 36.

In FIG. 11, the guide pin 44 inserts into the pre-drilled guide hole 36. This arrangement self guides the skive apparatus 38 which moves about the guide pin 44. The drive movement is generated the drive 39 which is coupled or secured to the shaft 52 or another portion of the skive 38. The drive 39 may vary depending upon the application and the composite being machined and can include, for example, a mechanical apparatus such as a drill press, a piezoelectric driven apparatus, or a manual apparatus such as an operator's hand. More particularly, the drive 39 generates drive movements in a repetitious back-and-forth motion as illustrated. Other modes of drive movement can be generated by the drive 39 and include a downward motion that selectively contacts the head 42 with the heater mat 22 and an upward motion that selectively disengages the head 42 from contact with the heater mat 22. Another mode of drive movement can include a rotational motion in which the skive 38 is spun continuously around a rotational axis.

The drive movement of the head 42 against the shroud fairing 18 (along with some downward force pressing the head 42 against the shroud fairing 18) breaks up the shell 26 and additional fabric layer(s) 32 of the heater mat 22 into particles P. In FIG. 11, the gas G flow in the channels 56 transports the machined particles P that result from the drive movement of the head 42 generally outward to the edge 60 of the head 42. The particles P and gas are blown out together from the edge 60 of the head 42 away from the area of the shroud fairing 18 being machined. The thickness of the fabric layer 32 above the electrical contacts 34 gradually decreases in the area of the heater mat 22 that comes into contact with the head 42 as a result of the mechanical action of the head 42 (and the thermal degrading of the shroud fairing 18 by the gas G if organic constituents are used).

As a result of removal of the organic material 62 and/or inorganic material by the skive apparatus 38 a more uniformly fabricated composite layering results. This more uniform layering allows a more effective electrical connection to be created between the electrical contact 34 and the electrical conduit 24 (FIG. 1).

Although the present invention has been described with reference to preferred embodiments, workers skilled in the art will recognize that changes may be made in form and detail without departing from the spirit and scope of the invention.

The invention claimed is:

1. An apparatus for thermal mechanical machining of a composite material, the apparatus comprising:

a head having an abrasive face;

a drive coupled to the apparatus to move the head to produce abrasion of the composite material by the abrasive face; and a shaft extending through the head and having a flow passageway for communicating a heated gas to an interface between the abrasive face and the composite material in a sufficient quantity to remove machined particles which result from relative motion of the abrasive face with respect to the composite material, wherein the shaft is coupled to the drive to transmit movement generated by the drive to the abrasive face.

2. The thermal mechanical apparatus of claim 1, wherein the drive oscillates the head with a generally downward motion that selectively contacts the abrasive face of the head with a composite material and a generally upward motion that selectively disengages the abrasive face of the head from contact with the composite material.

3. The apparatus of claim 1, wherein the drive oscillates the head with a back-and-forth repetitive motion against a composite material.

4. The apparatus of claim 1, wherein the shaft is configured to provide either a sufficient amount of oxygen to the abrasive face of the head to support combustion between the abrasive face and the composite material or a sufficient amount of an inert gas to the abrasive face of the head to support pyrolysis between the abrasive face and the composite material.

5. The apparatus of claim 1, further comprising:

a heater element for heating the gas in the flow passageway of the shaft.

6. An apparatus for thermal mechanical machining of a composite material, the apparatus comprising:

a head having an abrasive face;

a drive coupled to the apparatus to move the head to produce abrasion of the composite material by the abrasive face;

a shaft having a flow passageway for communicating a heated gas to an interface between the abrasive face and the composite material, wherein the abrasive face of the head includes channels for communicating the heated gas outward from the passageway and wherein the shaft extends through the head.

7. An apparatus for thermal mechanical machining of a composite material, the apparatus comprising:

a head having an abrasive face;

a drive coupled to the apparatus to move the head to produce abrasion of the composite material by the abrasive face;

a shaft having a flow passageway for communicating a heated gas to an interface between the abrasive face and the composite material; and a guide pin projecting past the abrasive face of the head.

8. An apparatus for thermal mechanical machining of a composite material, the apparatus comprising:

a head having an abrasive face;

a drive coupled to the apparatus to move the head to produce abrasion of the composite material by the abrasive face; and a shaft extending through the head and having a flow passageway for communicating a heated gas to an interface between the abrasive face and the composite material, wherein the shaft is coupled to the drive to transmit movement generated by the drive to the abrasive face.

9. An apparatus for thermal mechanical machining of a composite material, the apparatus comprising:

a disc shaped head having an abrasive face with channels therein; and a shaft extending through the head along a rotational axis thereof, the shaft defines a passageway that communicates with the channels to deliver a heated gas to an interface between the abrasive face and the composite material in a sufficient quantity to remove machined particles which result from relative motion of the abrasive face with respect to the composite material.

10. The apparatus of claim 9, further comprising:

a guide pin projecting past the abrasive face of the head and received in the composite material.

11. The apparatus of claim 9, further comprising:

a heater element disposed coaxially with the shaft.

12. The apparatus of claim 11, wherein the heater heats the gas flowing through the passageway to the abrasive face to a temperature sufficient to vaporize an organic compound in the composite material.

13. The apparatus of claim 11, wherein the heater heats the gas flowing through the passageway to the abrasive face to a temperature sufficient to carbonize an organic compound in the composite material.

14. The apparatus of claim 9, wherein the passageway is configured to provide either a sufficient amount of oxygen to the abrasive face of the head to support combustion between the abrasive face and the composite material or a sufficient amount of an inert gas to the abrasive face of the head to support pyrolysis between the abrasive face and the composite material.

15. A method of machining a composite material, the method comprising:

positioning an abrasive face of a thermal mechanical skive adjacent the composite material;

moving the abrasive face with respect to the composite material such that selective abrasion results therebetween; and delivering a gas through a passageway in the thermal mechanical skive to an interface between the abrasive face with the composite material, wherein the passageway is connected to channels along the abrasive face of the thermal mechanical skive.

16. The method of claim 15 and further comprising:

heating the gas to a temperature sufficient to vaporize or carbonize an organic component of the composite material.

17. The method of claim 15, wherein the gas is provided in a sufficient quantity to remove organic or inorganic particles that result from the moving of the abrasive face against the composite material.

18. The method of claim 15, wherein moving of the abrasive face with respect to the composite material includes a downward motion which selectively contacts the abrasive face with the composite material and an upward motion which selectively disengages the abrasive face from contact with the composite material.

19. The method of claim 15, wherein moving of the abrasive face with respect to the composite material includes a back-and-forth repetitive motion of the abrasive face against the composite head.

* * * * *